United States Patent [19]

Radice et al.

[11] 4,108,558

[45] Aug. 22, 1978

[54] LIPSTICK DISPENSER

[75] Inventors: Michael Radice, Oakland; Robert J. Sheffler, Morganville, both of N.J.

[73] Assignee: Revlon, Inc., New York, N.Y.

[21] Appl. No.: 769,017

[22] Filed: Feb. 16, 1977

[51] Int. Cl.[2] ..... A45D 40/06
[52] U.S. Cl. ..... 401/78
[58] Field of Search ..... 401/88, 68–78

[56] References Cited

U.S. PATENT DOCUMENTS

| | | | |
|---|---|---|---|
| 1,695,407 | 12/1928 | Anderson | 401/74 |
| 2,913,103 | 11/1959 | Isele | 401/78 |
| 3,706,500 | 12/1972 | Gruska | 401/78 |
| 3,850,183 | 11/1974 | Gruska | 401/78 X |

*Primary Examiner*—Stephen C. Pellegrino
*Attorney, Agent, or Firm*—Leon E. Tenenbaum

[57] ABSTRACT

There is provided an inner cylindrical sleeve for use in lipstick containers, said sleeve have diametrically opposed slots which permit movement of an elevator cup containing the lipstick and retention of the cup in three fixed positions.

1 Claim, 4 Drawing Figures

LIPSTICK DISPENSER

This invention relates to holders for projectable cosmetic sticks, and particularly relates to holders adaptable for displaying such sticks.

Holders for cosmetic sticks such as lipsticks or similar soft solid materials formed by molding or extrusion frequently have transparent covers, and are constructed so that the tip of the lipstick will be visible through the transparent cover, even when the lipstick is fully retracted into the holder. This is accomplished by locating the elevator cup holding the lipstick at a predetermined height in the holder. Such design permits display of the lipstick being used and enables the user to see the actual color without having to remove the cover.

Various means have been provided for keeping the cup in place at the predetermined height. Some of these means are described in U.S. Pat. Nos. 2,571,167; 2,636,598; 2,999,585; 3,335,853 and 3,515,493. However, none of the presently used means is free of problems.

Jarring of the holders in shipment or in handling often results in the movement of the cup from its fixed position. If the holder with the appropriate cover in place is not in an upright position, such movement results in the exposed lipstick impinging against the inside of the cover, disrupting the smooth contour of the lipstick, thereby making its appearance unappealing.

Another problem results from the exposure of the lipstick, even when the cup is fully retracted. In replacing the cover after use, the bottom edge of the cover often hits the exposed lipstick, unless the user is very careful to center the cover over the holder before assembly. Not only is there damage to the lipstick, but the bottom of the cover is smeared with the product which has to be wiped away so as not to be transferred to one's hands, clothing or other articles.

It is accordingly an object of the present invention to provide means for keeping the lipstick cup in place during shipment and handling of the lipstick holder.

It is another object of the present invention to provide means for keeping the lipstick cup in a particular position permitting exposure of the tip of the lipstick for display, and for retracting the cup and retaining it in place when it is not desired to expose the lipstick.

Other features and advantages of this invention will be apparent from the specification and claims when considered in connection with the accompanying drawings in which:

Figure 1:
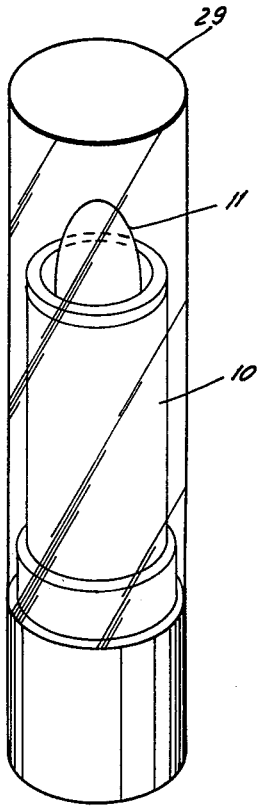
FIG. 1 is a perspective view of the holder in the closed position with the lipstick exposed.
Figure 2:
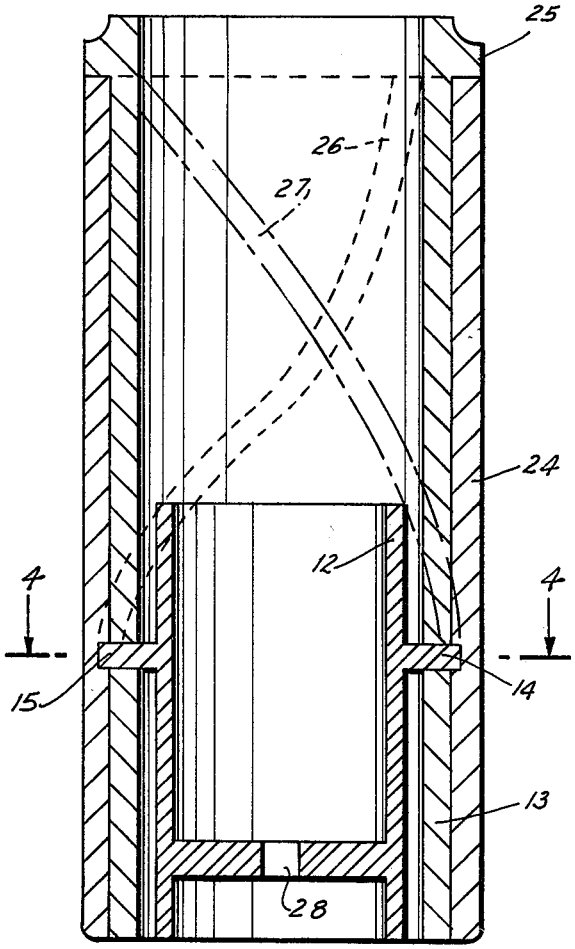
FIG. 2 is a longitudinal cross-sectional view of the uncovered holder from which the lipstick has been removed.
Figure 3:
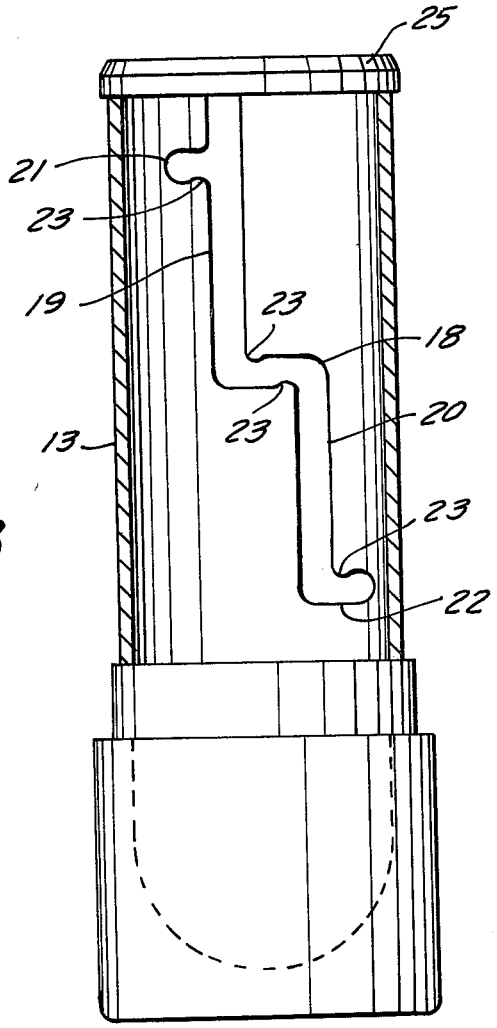
FIG. 3 is a longitudinal cross-sectional view of the inner sleeve showing details of the slot construction.
Figure 4:
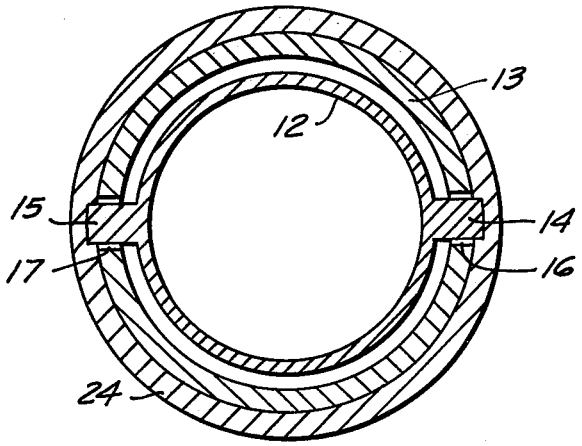
FIG. 4 is a cross-sectional view taken along the line 4—4 of FIG. 2.

As shown in the drawings the holder 10 for the lipstick 11 or other soft solid material comprises a cylindrical elevator cup 12 mounted for longitudinal or vertical movement in an inner cylinder or sleeve 13. Projecting from the outer cylindrical surface of the cup are a pair of diametrically opposed lugs or drift-pins 14 and 15 which are adapted to pass through a pair of diametrically opposed slots 16 and 17 formed in the side wall of the inner sleeve. Each slot or track of the inner sleeve consists of a lateral or horizontal portion 18 and two longitudinal or vertical portions 19 and 20 extending respectively upward and downward from the opposing ends of the lateral portion. Near the top end of the upper longitudinal portion 19 and at the bottom end of the longitudinal slot 20 are lateral passages 21 and 22 respectively, extending in opposite directions. The end lateral passages and the lateral portion in between are adapted to receive and hold the lugs or drift-pins. To assure retention of the lug when in position, the width of the lateral slots or tracks is narrowed at the points of where longitudinal and lateral slots intersect. These restrictions 23 serve to hold the lug in place but do not offer resistance to the movement of the lug when mechanical force is applied.

In order to move the cup to a desired position there is a cylindrical outer sleeve 24 capable of rotation about the inner sleeve and retained axially by the shoulder 25 on the inner sleeve. In the inner surface of the cylindrical wall of the outer sleeve are two diametrically opposed helicoidal grooves 26 and 27 which are engaged by the ends of the lugs to provide longitudinal motion to the cup. The bottom of the cup is desirably provided with one or more openings or vents 28 to permit expulsion of air when the lipstick is inserted into or molded in the cup.

The assembly is provided with a cover 29 which is preferably constructed of a transparent material.

The entire assembly may be constructed of plastic or other suitable material. If desired, certain portions of the assembly may be reinforced with metal bands, or a decorative outer shell or sleeve may be utilized.

In manipulating the holder, the lipstick may be moved up and down as desired. When in use, the cup is retained in place by the upper lateral passage 21. If it is desired to expose the lipstick when on display, the cup is retained in place by the lateral portion 18 of the slot. When not in use, the lipstick is moved down and the cup held in the place by the lateral passage 22.

It is to be understood that the description and drawings are given by way of illustration and are not to be considered as limiting.

We claim:

1. An inner cylindrical sleeve for use in a holder for dispensing liquids, said sleeve having a pair of diametrically opposed slots that are adapted to receive a pair of lugs projecting from a movable cup within the sleeve, each of said slots consisting of a lateral portion, two longitudinal portions extending respectively upward and downward from the opposing ends of the lateral portion, and lateral passages near the top end of the upper longitudinal portion and at the bottom end of the lower longitudinal portion, wherein the width of the lateral passages is narrowed at the points where the logitudinal and lateral passages meet.

* * * * *

UNITED STATES PATENT OFFICE

CERTIFICATE OF CORRECTION

Patent No. 4,108,558 Dated August 22, 1978

Inventor(s) Michael Radice and Robert J. Sheffler

It is certified that error appears in the above-identified patent and that said Letters Patent are hereby corrected as shown below:

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*